United States Patent [19]

Valiga

[11] 4,375,930

[45] Mar. 8, 1983

[54] PERMANENT DISPOSAL VAULT FOR CONTAINERS

[75] Inventor: Richard E. Valiga, Center Square, Pa.

[73] Assignee: Stabatrol Corp., Norristown, Pa.

[21] Appl. No.: 212,792

[22] Filed: Dec. 3, 1980

[51] Int. Cl.[3] ..... E02D 29/00

[52] U.S. Cl. ..... 405/128; 405/267

[58] Field of Search ..... 405/128, 129, 266, 267; 252/633

[56] References Cited

U.S. PATENT DOCUMENTS 4,166,709 9/1979 Valiga ..... 405/128

4,189,254 2/1980 Akesson ..... 405/128

FOREIGN PATENT DOCUMENTS 2152172 4/1973 Fed. Rep. of Germany ..... 405/128

2430371 1/1976 Fed. Rep. of Germany ..... 405/128

*Primary Examiner*—David H. Corbin

*Attorney, Agent, or Firm*—Harry B. Keck

[57] ABSTRACT

Containers of chemical hazardous waste materials can be permanently vaulted by distributing the containers on a base surface apart from one another and thereafter filling the space between the deposited containers with a cementitious substance and covering the containers with a slab of cementitious substance whereby each individual container is isolated within a structural skeleton of the cementitious substance. The cementitious material will retain its structural integrity after the container has deteriorated or corroded. Multiple tiers of containers may be accumulated in this fashion and encapsulated within a permanent disposal vault.

5 Claims, 7 Drawing Figures

PERMANENT DISPOSAL VAULT FOR CONTAINERS

BACKGROUND OF THE INVENTION

1. Field of the Invention

This invention relates to a permanent vault for disposing of containers particularly containers which are filled with chemical hazardous waste materials.

2. Description of the Prior Art

Modern industry creates huge quantities of waste materials which include nuclear waste materials, biodegradable waste materials, municipal wastes and hazardous chemical wastes. The disposition of hazardous chemical wastes is a source of great concern to environmentalsts because of the tendency of such chemical hazardous waste materials to leach into the natural water supply and thereby to contaminate drinking water. Many of the past practices for disposing of such hazardous chemical waste materials are unacceptable today. There are hundreds of isolated landfills where waste disposers have merely dumped the hazardous chemical waste materials into open pits, into mineshafts, into public streams, etc.

Frequently, chemical hazardous waste materials are accumulated by the waste generators in fiber or metal drums which are stored at the premises of the waste generator until a sufficient quantity is accumulated to warrant removal from the premises and disposal by a waste disposal operator. It has been a past practice, unacceptable today, to dump the complete containers into landfills.

A more acceptable procedure for such materials is described in U.S. Pat. No. 4,166,709 where a waste disposal basin is provided above the existing high water table level in the region of the disposal site. The basin is lined with a water-impervious basin liner and an encapsulation is prepared from a water-impermeable layer of material and a further water-impervious layer of material. The chemical hazardous waste materials are deposited above the water-impervious layer of material until the permanent vault is filled to the satisfaction of the disposal site operator. Thereafter a covering water-impervious layer is applied and a further water-impermeable layer of material is applied forming a double encapsulation around the chemical hazardous waste materials. Thereafter the permanent vault is covered with indigenous earth materials, further covered with a water-impervious layer of materials to preclude entry of surface water into the vault and thereafter the region is covered with topsoil and revegetated.

While this foregoing permanent encapsulation vault is environmentally acceptable, the use of such vaults for confining containerized chemical hazardous waste materials presents some anticipated difficulties as the containers may deteriorate from corrosion and collapse. Such deterioration may create void spaces within the encapsulation vault which may result in geological weaknesses in the structure permitting the development of structural cracks or other openings in the double encapsulation of the vault. The vaults are provided with permanent monitoring installations to provide prompt observation of the occurrence of such faults and to permit the disposal site operator to take corrective measures before the confined chemical waste materials can create environmental damage.

SUMMARY OF THE INVENTION

The principal object of the present invention is to provide a permanent disposal vault for containers of hazardous materials which will not result in loss of its structural integrity as a result of deterioration and corrosion of the containers.

It is a further object of the invention to provide individual encapsulation for each container of hazardous waste materials and thereby to avoid comingling of different hazardous waste materials within a permanent disposal vault.

It is a further object of the invention to accomplish these beneficial results in an economical and efficient process.

According to this invention, a permanent disposal site is selected by the disposal site operator and prepared for permanent disposal of hazardous waste materials which are supplied to the disposal site operator in containers such as metal drums, fiber drums, plastic drums and the like. The disposal site is provided with a base slab of cementitious, water-impermeable material having a generally horizontal base surface. The individual containers of waste material are distributed over the base surface in an acceptable array whereby all of the containers are spaced apart from one another by a distance which is preferably at least 2 inches. After all of the area of a selected base surface is occupied by the containers, the space between the containers above the base surface is filled with a cementitious material. Temporary or permanent wall forms are positioned around the perimeter of the selected base surface area to confine the cementitious material until it has set and hardened. Cementitious material is provided as a slab above the tops of the container array about 2 inches thick serving as a base slab for a second tier of waste disposal containers which can be distributed in an appropriate array. Appropriate wall forms are provided around the perimeter of the second container array and a second pouring of cementitious material is applied into the space between the containers in the second container array, extending above the tops of the containers to form a covering slab having a top surface which can constitute the base surface for a third tier of containers.

Multiple tiers of containers can be stacked in this fashion. When the entire waste disposal site is filled, appropriate encapsulation measures as described in copending U.S. patent application Ser. No. 212,791, filed Dec. 3, 1980, can be carried out and the entire area can be revegetated.

Each individual container is encapsulated in the cementitious material according to this invention. In the event of deterioration or corrosion of any individual container, the volume initially defined by the container remains defined by the hardened cementitious material and no void spaces are created which might result in unwanted structural failure of the vault encapsulation coverings.

DESCRIPTION OF THE PREFERRED EMBODIMENTS

Figure 1:
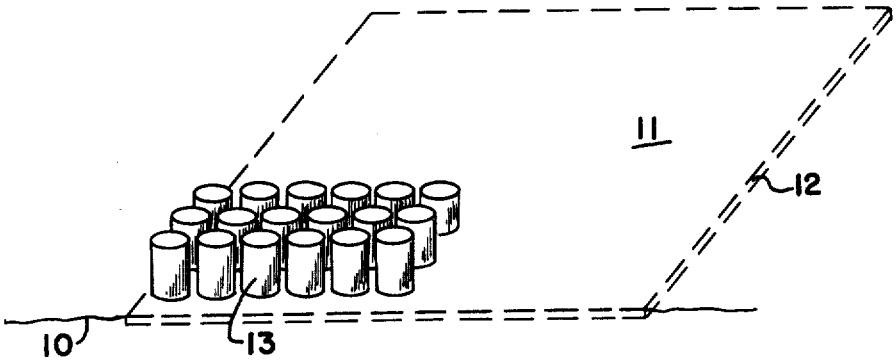
FIG. 1 is a schematic perspective illustration of an array of containers which are to be permanently vaulted according to the present invention.

Referring to FIG. 1, a waste disposal site is established in a terrain indicated by the numeral 10 by defining a base area 11 which is covered with a slab 12 of water-impermeable material, preferably a cementitious material. A preferred cementitious material is a formed in situ slab which can be applied by mixing Portland cement or other cementitious substance with the clay, rock, shale or other indigenous earth material and mixing the materials in situ by working the base area 11 with agricultural tools such as a disk harrow to accomplish mixing and a sheepfoot roller to accomplish compaction. In place of the indigenous earth materials, the inert filler material for the cementitious slab 12 may be sand, gravel, fly ash, calcium oxide, inert industrial wastes such as ground glass, or in part waste sludges.

Other cementitious substances include calcium sulfate hemihydrate, anhydrous calcium sulfite, and other cementitious substances. Portland cement is the preferred cementitious substance because of its availability, its inert properties, its relatively low cost and because of the manner in which it can be extended with inert substances. The cementitious material is wetted if required and allowed to harden into a slab 12 having a thickness of at least 2 inches. Slabs from 2 to 12 inches are contemplated. The slab 12 also serves to level any geological irregularities in the base site 11.

Figure 2:
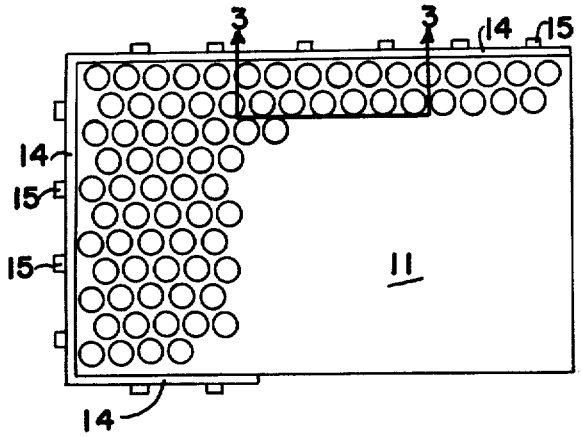
FIG. 2 is a plan view of a selected area of a base surface showing perimeter wall forms and a container array.
Figure 3:
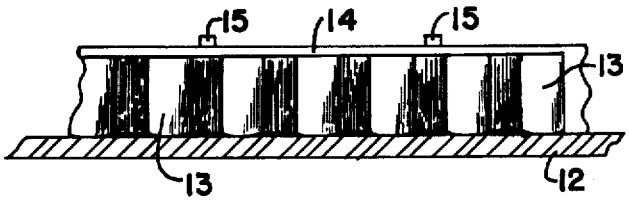
FIG. 3 is a cross-sectional view taken along the lines 3—3 of FIG. 2.

After the slab 12 is prepared, containers 13 are deposited on the slab 12 in an appropriate array whereby they are spaced apart from one another by a distance which preferably is at least 2 inches. The array of containers 13 can be rectangular but preferably an equilateral triangular array as shown in FIG. 2 provides maximum density of the containers. Appropriate wall forms 14 are provided around the perimeter of the container array preferably extending above the top level of the containers as shown in FIG. 3. The wall forms 14 may be permanent walls of concrete blocks, bricks, metal sheets, but preferably the wall forms 14 are temporary wooden or plastic or metal concrete retaining forms held in place by appropriate columns 15. Temporary concrete forms can be removed and reused in the present vaults.

Figure 5:
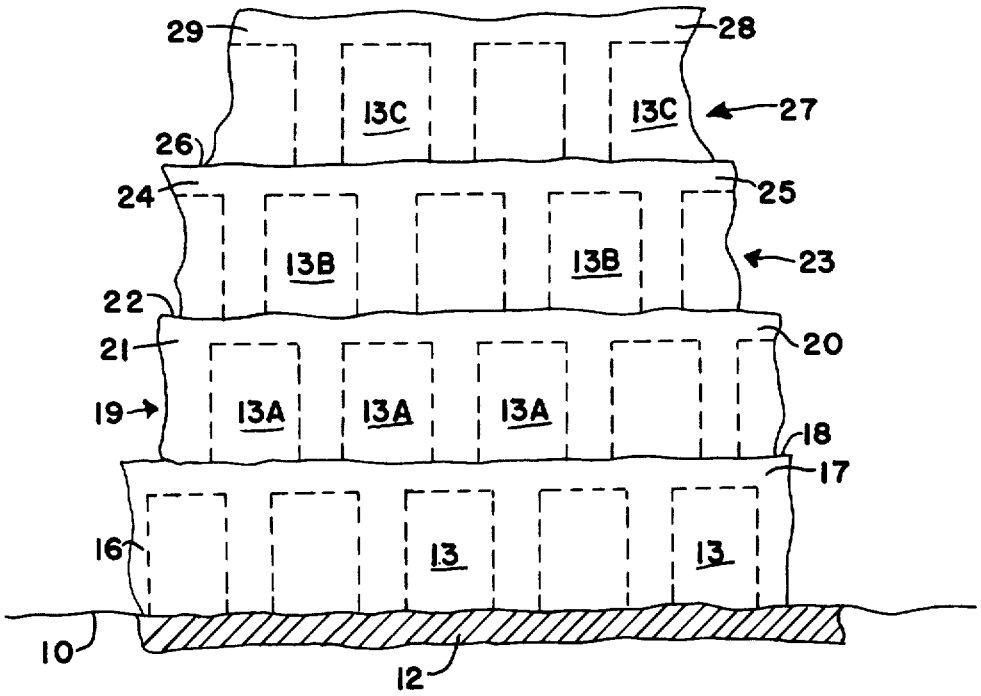
FIG. 5 is a cross-sectional view through a waste disposal vault according to this invention having four tiers of container array disposals.

After the selected area of the base area 11 is covered with an array of containers, the operator introduces a plastic cementitious material 16 as best shown in FIG. 5 into the space between the containers 13 and covering the containers 13 to form a cementitious slab 17. The cementitious material 16 is allowed to harden and the top surface 18 of the cementitious slab 17 forms a base surface for the establishment of a second tier 19 of containers **13*a* which are provided in an array on top of the surface 18**.

Figure 4:
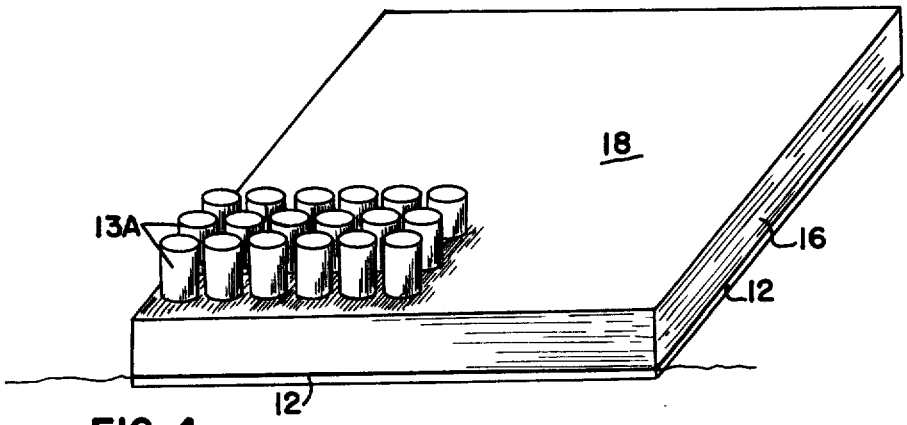
FIG. 4 is a perspective illustration similar to FIG. 1 showing a container array in a second tier pattern.

Referring to FIG. 4 it will be observed that the cementitious material 16 has encapsulated the container array with each of the individual containers being entirely individually encapsulated. The operator can commence a second tier 19 of container disposals on the surface 18 as shown in FIG. 5. Appropriate wall forms are installed about the perimeter of the second tier 19 and cementitious material 20 is applied in a plastic state by the disposal site operator into the space between the containers **13*a* and above the containers 13*a* to form a cementitious slab 21. Each of the second tier containers 13*a* is thus encapsulated by the slabs 17, 21 and the cementitious material 20. The cementitious slab 21 has a top surface 22 which can form a base area for a third tier 23 of disposal for containers 13*b*. The perimeter of the array of containers 13*b* is provided with appropriate wall forms and the disposal site operator applies plastic cementitious material 24 in the space between the containers 13*b* and covering the containers to form a cementitious slab 25. The cementitious slab 25 has a top surface 26 which may form a base area for a fourth tier 27 of disposal for containers 13*c*. The perimeter of the containers 13*c* is provided with appropriate wall forms and the site disposal operator introduces cementitious material 28 into the space between the containers 13*c* and covering the containers 13*c* to form a cementitious slab 29**.

It will be observed from inspection of FIG. 5 that the number of tiers of disposal facility can be extended beyond the four tiers which are there illustrated. It will further be observed that each of the containers **13, 13*a*, 13*b*, 13*c*** is individually encapsulated within cementitious material so that the structural failure of any one of the containers will not create any structural failure of the waste disposal installation.

The cementitious material which is employed to fill the space between containers and to cover the containers is preferably the same material which is employed to establish the base slab 12. The cementitious material which is deposited between containers must be mixed into a plastic state by an appropriate concrete mixing device or other mixing device. The top surfaces 18, 22, 26 should be leveled and smoothed by appropriate concrete leveling devices to provide a horizontal surface for the succeeding tiers of containers.

Figure 6:
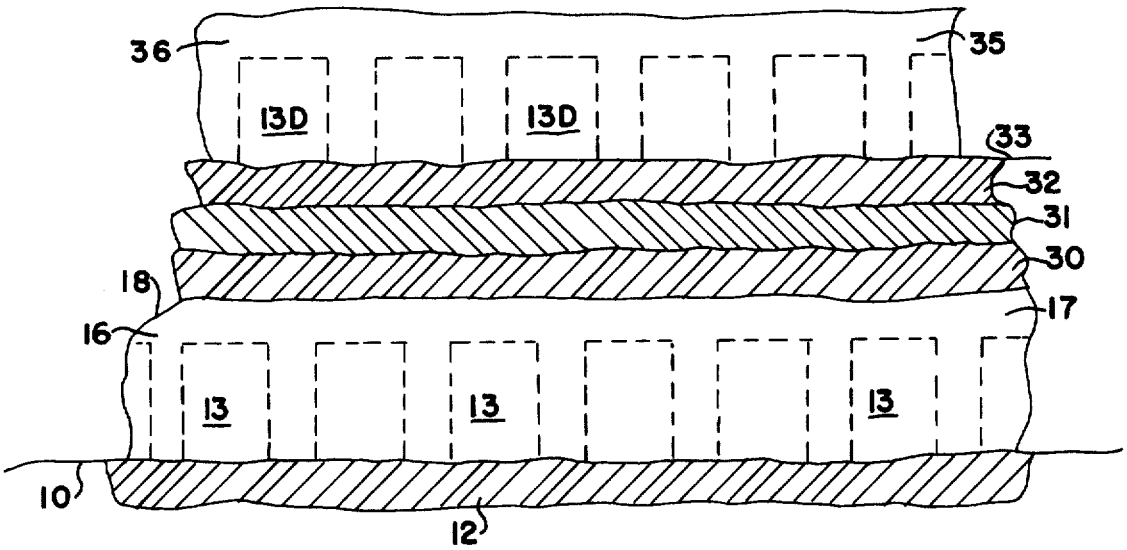
FIG. 6 is a cross-sectional view, similar to FIG. 5, showing an alternative embodiment of the present invention.

A further embodiment of the present invention is illustrated in FIG. 6 wherein a first tier of containers is encapsulated with a cementitious substance 16 and provided with a top surface 18. The covering cementitious slab 17 may be covered with additional slabs 30, 31, 32 of cementitious materials which incorporate bulk hazardous chemical waste substances. Such slabs are described in copending U.S. patent application Ser. No. 165,280, filed July 2, 1980. Accordingly, the slabs 30, 31, 32 may be formed by mixing and compaction in situ of a cementitious substance, inert fillers and chemical waste sludges. The slabs 30, 31, 32 alternatively may be formed in appropriate mixing devices such as concrete mixers and can be applied and compacted with appropriate earth moving equipment such as bulldozers, sheepfoot rollers and the like.

While FIG. 6 illustrates three supplemental slabs 30, 31, 32 it should be apparent that one, two, three or more such incremental slabs might be employed in the present disposal vault.

The topmost slab 32 has a top surface 33 which serves as a base area for an incremental tier 34 of containers **13*d* which are provided in an array and encapsulated with cementitious material 35 and covered with a cementitious slab 36**.

Figure 7:
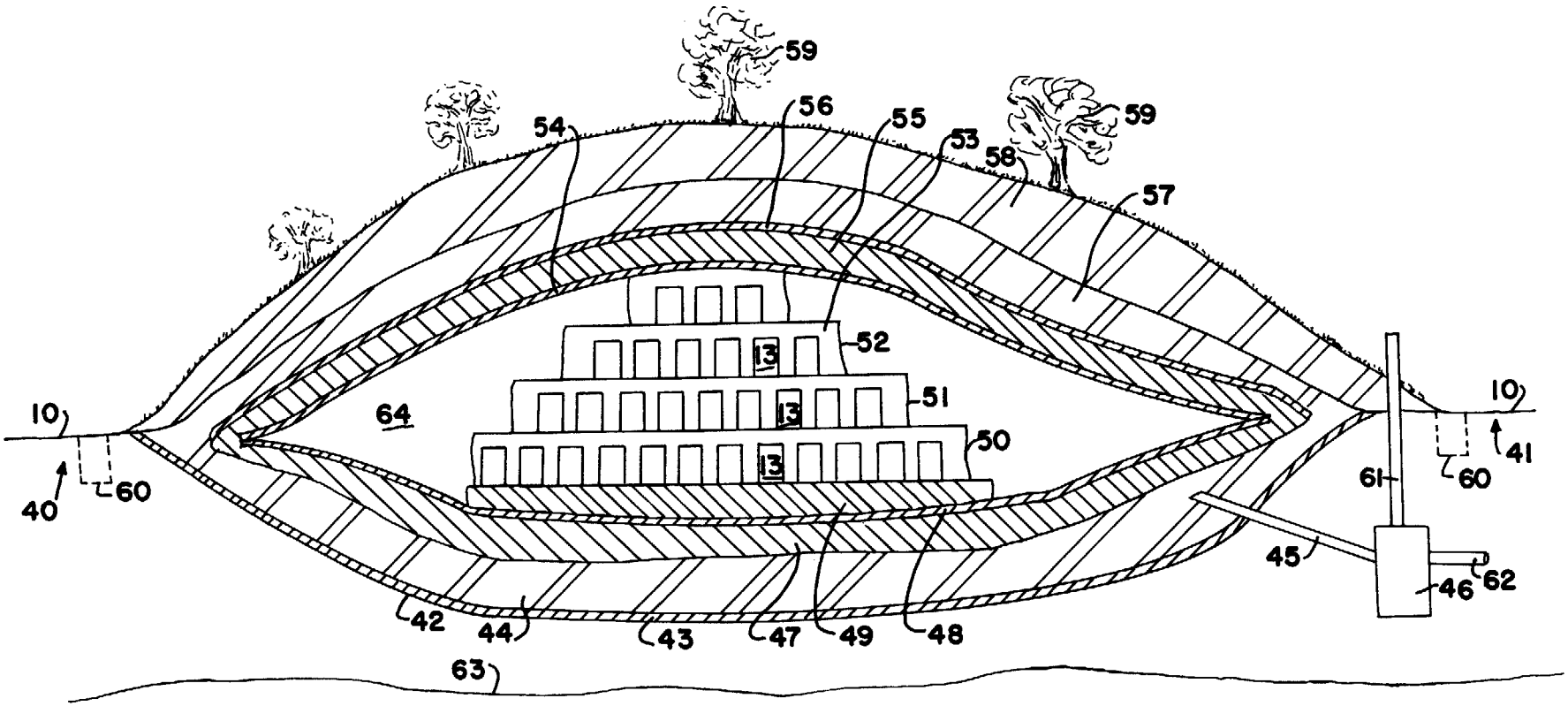
FIG. 7 is a cross-sectional view of a waste disposal site illustrating a preferred embodiment for incorporating the present invention into existing terrain.

Referring to FIG. 7, the combination of the present vaulting method for containers into a permanent disposal vault is illustrated.

In FIG. 7 the terrain 10 slopes generally from an upper end 40 to a lower end 41. An excavation basin 42 is provided in the terrain 40 and is lined with a water-impervious coating 43 which is preferably a performed film of plastic such as polyethylene, polypropylene, polyethylene terephthalate, and the like. The film thickness preferably is about 6 mils. The film 43 covers the entire surface of the excavation basin 42. Where the hazardous waste materials in the vault might be organic solvents, it may be desirable to employ a cementitious coating covered with a sprayed-on water-impervious film such as asphalt on concrete to constitute the water-impervious coating 43, particularly where the organic waste materials might dissolve or accelerate the deterioration of a plastic film.

A layer of indigenous earth materials 44, such as clay, rocks, sand, gravel, is applied on top of the water-impervious film 43.

The excavation basin 42 has a slope from its upper end 40 to its lower end 41 and also slopes from both sides towards its center. Positioned within the central region of the excavation basin 42 is a liquid collection system having an outlet conduit 45 connected to a sump 46.

Above the layer of earth materials 44 is a layer of cementitious material 47 which is preferably a formed in situ cementitious material as described herein. A second water-impervious film 48 is applied on top of the water-impermeable layer 47. A covering layer 49 is applied on top of the water-impervious layer 48. Where containers are to be vaulted according to this invention, the covering layer 49 preferably is the cementitious slab corresponding to the slab 12 of FIG. 1.

After an appropriate covering layer 49 has been applied, multiple tiers 50, 51, 52, etc., are introduced as herein described. When the accumulation 53 of hazardous waste material is completed, the vault is closed by applying a third water-impervious layer 54 whose edges engage the edges of the second water-impervious layer. Thereafter a second water-impermeable layer 55 is applied on top of the third water-impervious layer 54. The perimeter of the second water-impermeable layer 55 is joined with the perimeter of the first water-impermeable layer 47. Thereby the accumulation 53 of hazardous waste materials is doubly encapsulated within the water-impervious layers 48, 54 and within the water-impermeable layers 47, 55. Thereafter a fourth water-impervious layer 56 is applied on top of the second water-impermeable layer 55 to serve as a shield for any surface waters which may thereafter materialize. A layer 57 of indigenous earth materials is applied above the fourth water-impervious layer. A final layer 58 of topsoil is applied on top of the layer 57 of indigenous earth materials and is contoured at the perimeter of the excavation basin 42 to conform with the prior existing terrain 10.

Thereafter vegetation 59 is planted and nurtured above the encapsulation vault.

Preferably a water-diverting ditch 60 is provided to direct the flow of surface waters around the encapsulation vault to accommodate any unnatural diversions of surface waters resulting from the existence of the vault.

A conduit 61 is connected to the sump 46 to provide for monitoring of any liquid accumulations which may comprise leakage or leachate from the encapsulation vault. In the event of a major fault, all of the liquid leakage or leachate will be collected from the conduit 45 and can be delivered through a conduit 62 to a collection tank (not shown) where the liquid leakage or leachate can be collected and prevented from causing environmental damage.

It will be observed that the entire disposal vault is positioned above the level 63 of high water table in the region where the vault is located. Thus the accumulated hazardous waste materials do not communicate with the natural underground water patterns.

It will be observed in FIG. 7 that the entire accumulation 53 of hazardous waste materials is encapsulated within cementitious materials which forms a skeletal structure which will remain intact despite any deterioration or corrosion of the containers 13.

The cementitious material which is employed to encapsulate the containers is not required to have excessive compressive strength. Appropriate compositions can be prepared from mixtures having one part Portland cement to as many as eight parts inert filler by weight.

Referring to FIG. 1 and FIG. 4, during the time when the containers 13, 13*a* are being distributed in a container array, it is desirable that the containers be covered with an appropriate water-resistant film such as a sheet of plastic film (polyethylene, polypropylene, polyethylene terephthalate, etc.) to prevent any accumulation of atmospheric moisture on the container lids or within the container array.

The present invention permits a waste disposal operator to maintain records of the precise location of each individual container of materials along with an inventory of the precise nature of waste materials within each container. Thus, in the event a fault occurs, the resulting liquid leakage or leachate which will be observed in the sump 46 through the monitoring conduit 61 can be identified as to its precise location within the accumulation 53 through appropriate chemical analyses. The combination of appropriate chemical analysis and inventory will permit the disposal site operator to identify with some precision the location of the fault and permit taking expeditious corrective steps.

In any particular vault, the accumulation 53 of hazardous waste materials may include not only containerized waste materials of the type illustrated in FIG. 7 but may also include bulk hazardous waste materials with adequate precautions for their stability. Stabilized sludges, for example, can be layered as shown in FIG. 6, layers 30, 31, 32. Stabilized sludges may be employed as the cementitious material which fills the space between the containers within a container array. Bulk waste materials which are essentially inert, i.e., do not contain hazardous leachable chemical ingredients, may be employed as buffers and filler materials around the perimeter of encapsulated containers as shown at 64 in FIG. 7.

Typical disposal vaults according to this invention may have a length from the upper end 40 to the lower end 41 of several hundred feet. Vaults of 200 to 500 feet in length are contemplated. The vaults may have a width from side to side of 50 to 200 feet. The precise size of the vault depends upon the geography of the region, the anticipated production of waste materials, economics, and other factors.

I claim:

1. A method for encapsulating containers which comprises:

(1) establishing a base surface;

(2) depositing said containers on said base surface apart from one another;

(3) establishing wall forms around a preponderance of the perimeter of deposited containers;

(4) applying a cementitious substance within said wall forms to the said base surface to fill the space between said deposited containers and covering said deposited containers;

(5) leveling the top of said cementitious substance within said wall frames to form a cover slab at least two inches thick above said deposited containers and to form a second tier base surface;

(6) hardening said cementitious substance to form a monolithic block including the said cover slab and the said space between said deposited containers.

2. The method of claim 1 wherein said base surface is the top surface of a slab of hardened cementitious substance.

3. The method of claim 1 including the following additional steps:

(7) depositing additional containers on said second tier base surface spaced-apart from one another;

(8) establishing the second tier wall forms around a preponderance of the perimeter of deposited additional containers;

(9) applying a cementitious substance within said second tier wall forms to the said second tier base surface to fill the space between said deposited additional containers and covering said deposited additional containers;

(10) leveling the top of said cementitious material within said second tier wall frames to form a cover slab at least two inches thick above said deposited additional containers and to form a third tier base surface;

(11) hardening said cementitious substance to form a monolithic block including the said cover slab and the said space between said additional deposited containers.

4. The method of claim 1, 2 or 3 wherein the said cementitious substance is a mixture of Portland cement and inert fillers.

5. A vault for permanent disposal of containers of waste materials comprising:

water impermeable basin having a liquid-confining basin liner which is located above the high water table of the region;

multiple individual containers, each containing waste materials, said containers being spaced apart from one another;

cementitious filler forming a monolithic block below, above and between said containers;

water impervious incapsulation film surrounding said monolithic block;

monolithic water impermeable incapsulation for the said incapsulation film;

covering for said vault being contoured to accommodate the existing surface grade.

* * * * *